US006570367B2

(12) United States Patent
Bartenschlager et al.

(10) Patent No.: US 6,570,367 B2
(45) Date of Patent: May 27, 2003

(54) VOLTAGE GENERATOR WITH STANDBY OPERATING MODE

(75) Inventors: Rainer Bartenschlager, Kaufbeuren (DE); Martin Brox, München (DE); Albert Graf V. Keyserlingk, München (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 10/090,278

(22) Filed: Mar. 4, 2002

(65) Prior Publication Data

US 2002/0121883 A1 Sep. 5, 2002

(30) Foreign Application Priority Data

Mar. 2, 2001 (DE) ..... 101 10 273

(51) Int. Cl.[7] ..... G05F 1/59
(52) U.S. Cl. ..... 323/269
(58) Field of Search ..... 323/268, 269, 323/274, 275, 280, 303, 350

(56) References Cited

U.S. PATENT DOCUMENTS 4,920,309 A * 4/1990 Szepesi ..... 323/269
5,945,815 A * 8/1999 Elliott ..... 323/269
5,973,484 A * 10/1999 Cho ..... 323/269
6,144,194 A * 11/2000 Varga ..... 323/269
6,222,353 B1 * 4/2001 Pattamatta et al. ..... 323/269
6,384,672 B2 * 5/2002 Oh ..... 323/269

FOREIGN PATENT DOCUMENTS

EP 0 469 587 B1 2/1992 ..... G05F/3/20
EP 0 647 946 B1 4/1995 ..... G11C/11/407

* cited by examiner

*Primary Examiner*—Jeffrey Sterrett
(74) *Attorney, Agent, or Firm*—Laurence A. Greenberg; Werner H. Stemer; Ralph E. Locher

(57) ABSTRACT

A voltage generator for producing an internal supply voltage has a standby voltage generator and a voltage generator for normal operation that are controlled in common by a reference voltage. In addition, a comparator stage is provided whose switching threshold is set lower than the reference voltage by using a voltage divider that is connected to the reference voltage. The additional comparator stage thus activates the voltage generator for normal operation when the internally produced voltage falls below its switching threshold so that the internal supply voltage is stabilized.

14 Claims, 3 Drawing Sheets

10
VEXT
VEXT
11
12
41
42
VREF
VINT
20
111
VSS
VEXT
VEXT
VEXT
21
230
216
215
22
211
212
PWRON
ACTIVE
23
214
26
25
213
VSS
VEXT
341
31
36
342
361
FILTER
35
VINT
VREF
VSS
34
PWRON
311

VOLTAGE GENERATOR WITH STANDBY OPERATING MODE

BACKGROUND OF THE INVENTION

Field of the Invention

The invention relates to a voltage generator that can be operated in a normal operating mode and in a standby operating mode. In addition, the invention relates to a method for operating such a voltage generator.

Voltage generators are used in integrated circuits in order to produce an internal supply voltage on a semiconductor chip, from an externally supplied supply voltage. The internal supply voltage is adapted to the requirements of the internal functional units of the integrated circuit. Thus, voltages can be produced whose magnitude deviates from the magnitude of the externally supplied voltage. The internal voltage can be higher or lower than the externally supplied voltage. Moreover, the voltage regulator for the internally supplied voltage ensures that a sufficiently constant voltage is produced independently of fluctuations of the externally supplied supply voltage, and as much as possible, also independently of the load that will be driven internally. The voltage generators consume dissipated power. Voltage generators are therefore designed for a normal operation in which a high drive capability is achieved and the power dissipation is high, and in addition for a standby operation in which the voltage generator has a low drive capability and the power dissipation is low.

In standby operation, only selected functional units of the integrated circuit are switched on. The circuit in standby operating mode can be activated to switch over from standby operation to normal operation. Correspondingly, the voltage generator also switches over from its standby operating mode, in which the dissipated power loss is low, into a normal operation, which consumes a higher dissipated power.

A conventional voltage generator with a standby operating mode and a normal operating mode is shown in FIG. 1. The voltage generator in FIG. 1 has a voltage generator 10 for standby operation and a voltage generator 20 for normal operation. Generator 10 is always switched on, both in standby operation and also in normal operation. Generator 10 has a low dissipated power loss. Generator 20 is also connected in normal operation, produces an output voltage with a high drive capability, and correspondingly has a high dissipated power loss. The output terminal connections of generators 10, 20 are coupled with one another. External supply voltage VEXT is supplied to generators 10 and 20. Generators 10 and 20 generate the regulated internal voltage VINT from the external supply voltage VEXT and provide the regulated internal voltage VINT at the output terminal connection 42.

Both voltage generators 10, 20 have a circuit design that is identical in principle. A differential amplifier 11 or 21 is supplied with power by the external supply voltage VEXT, and compares a reference voltage VREF with the voltage VINT that is produced at the output. The gate of a current source transistor 12 or 22 is driven in dependence upon the comparison. The drain-source current path of current source transistor 12 or 22 is connected between a terminal for receiving the external supply voltage VEXT and the output terminal 42 providing the internal supply voltage VINT. It is noted that corresponding inputs of the differential amplifiers 11 or 21 are driven by the same reference signal VREF.

In comparison to the always-active standby voltage generator 10, voltage generator 20, which is active only in normal operation, has a switching device 23 through which the differential amplifier 21 can be switched on and off. The switching device 23 switches the voltage generator 20 on in normal operation when higher driving power is required. This state is communicated to the voltage generator by the received signal ACTIVE. Moreover, the voltage generator 20 is activated only if it has been ensured that a sufficiently high supply voltage is applied, known as the power-on state. This is communicated to the voltage generator 20 by the signal PWRON, which is combined with the signal ACTIVE through a logical AND operation. The logical combination of the signal ACTIVE with the signal PWRON prevents generator 20 from being activated too early. In principle, it can also be omitted.

The different current driving capacity of the voltage generators 10, 20 is obtained by providing transistor 22 with a channel that is wider, for example, by a factor of n than the channel of transistor 12. Likewise, the differential amplifier 21 includes transistors that are dimensioned larger by a factor of n than corresponding transistors in the differential amplifier 11.

It is problematic that the circuit supplied by the voltage generator shown in FIG. 1 can assume states in which a high current is drawn from the voltage generator when the signal ACTIVE does not indicate normal operation. This error situation can arise in particular if there are complex functional units that are driven. If in such a case, only the standby voltage generator 10 with a low driving power is switched on, but not voltage generator 20 for supplying high driving power, then the internal voltage can break down because the standby voltage generator 10 cannot provide sufficient current. In this state, the integrated circuit can block, which requires the external supply voltage to be switched off and a renewed startup to be performed in order to remove the error situation. The functional capacity and the functional reliability of the overall system is then adversely affected, so that such an error situation should be avoided to the greatest possible extent.

SUMMARY OF THE INVENTION

It is accordingly an object of the invention to provide a voltage generator that has both a standby and a normal operating mode and which overcomes the above-mentioned disadvantages of the prior art apparatus of this general type.

In particular, it is an object of the invention to provide a voltage generator that has both a standby and a normal operating mode, and that operates in a functionally reliable manner.

With the foregoing and other objects in view there is provided, in accordance with the invention, a voltage generator that includes: an output connection for providing an output voltage; an input connection for receiving a first reference potential; and a first voltage regulator having an output stage and a comparator stage for driving the output stage. The output stage has an output connected to the output connection. The comparator stage has an input connected to the input connection for receiving the first reference potential and has another input connected to the output stage. The voltage generator also includes a second voltage regulator having an output stage, a comparator stage for driving the output stage, and a switch. The output stage has an output connected to the output connection. The comparator stage of the second voltage regulator has an input connected to the input connection for receiving the first reference potential and has another input connected to the output stage. The switch is for switching the second voltage regulator on and off. The voltage generator includes a connection for receiving a second reference potential that is different than the first reference potential. The voltage generator also includes an additional comparator stage having a first input connected to the connection for receiving the second reference potential. The additional comparator stage has a second input connected to the output connection. The additional comparator stage has an output providing an output signal for controlling the switch of the second voltage regulator.

In accordance with an added feature of the invention, there is provided a voltage divider having an input connected to the input connection for receiving the first reference potential. The voltage divider has an output connected to the connection for receiving the second reference potential.

In accordance with an additional feature of the invention, there is provided a further connection for receiving a reference potential. The voltage divider includes a first resistor and a second resistor connected in series with the first resistor. The voltage divider is connected between the input connection for receiving the first reference potential and the further connection; and the voltage divider includes an intermediate tap connected to the first input of the additional comparator stage.

In accordance with another feature of the invention, the comparator stage of the first voltage regulator includes a first current branch, a second current branch, and a current switch having a current source connected to the first current branch and to the second current branch; the first current branch of the comparator stage of the first voltage regulator forms an output of the comparator stage of the first voltage regulator; the comparator stage of the second voltage regulator includes a first current branch, a second current branch, and a current switch having a current source connected to the first current branch of the comparator stage of the second voltage regulator and to the second current branch of the comparator stage of the second voltage regulator; the first current branch of the comparator stage of the second voltage regulator forms an output of the comparator stage of the second voltage regulator; the additional comparator stage includes a first current branch, a second current branch, and a current switch having a current source connected to the first current branch of the additional comparator stage and to the second current branch of the additional comparator stage; the first current branch of the additional comparator stage forms an output of the additional comparator stage; the first reference potential controls the first current branch of the comparator stage of the first voltage regulator; the first reference potential controls the first current branch of the comparator stage of the second voltage regulator; the first reference potential controls the first current branch of the additional comparator stage; the output voltage controls the second current branch of the comparator stage of the first voltage regulator; the output voltage controls the second current branch of the comparator stage of the second voltage regulator; and the output voltage controls the second current branch of the additional comparator stage.

In accordance with a further feature of the invention, there is provided a connection for receiving a supply potential. The output stage of the first voltage regulator includes a transistor having a controlled path connected between the connection for receiving the supply potential and the output connection. The transistor of the output stage of the first voltage regulator has a gate connected to the output of the output stage of the first voltage regulator. The output stage of the second voltage regulator includes a transistor having a controlled path connected between the connection for receiving the supply potential and the output connection. The transistor of the output stage of the second voltage regulator has a gate connected to the output of the output stage of the second voltage regulator.

In accordance with a further added feature of the invention, the current source of the second voltage regulator has a higher current driving capacity in comparison with the current source of the first voltage regulator.

In accordance with a further additional feature of the invention, there is provided a switch that is controlled through the output of the additional comparator stage to produce one of two logic levels.

In accordance with yet an added feature of the invention, there is provided a logic gate having a first input connected to the switch. The logic gate has a second input for receiving an enable signal. The logic gate has an output connected to the switch of the second voltage regulator.

In accordance with yet an additional feature of the invention, there is provided a low-pass filter coupled with the switch. In accordance with yet another feature of the invention, there is provided a connection for receiving a supply voltage. The additional comparator stage and the comparator stage of the second voltage regulator are switched on and off dependent on a signal that indicates whether the supply voltage is sufficiently high for supplying power to the first voltage regulator, the second voltage regulator, and the additional comparator stage. The first voltage regulator cannot be switched on and off by that signal.

In accordance with yet another added feature of the invention, there is provided a register that is driven by the additional comparator stage.

With the foregoing and other objects in view there is provided, in accordance with the invention, a method for operating the voltage generator, that includes steps of: providing the voltage generator described above; producing the output voltage with the second voltage regulator; using first reference potential to control the second voltage regulator; setting the second reference voltage to be lower than the first reference voltage; and using the switch to switch on the second voltage regulator when the output voltage falls below the second reference voltage.

In accordance with an added mode of the invention, the method includes setting a storage element whenever the output voltage falls below the second reference voltage.

Besides voltage generators 10 and 20, already known from FIG. 1, the voltage generator according to the invention has an additional comparator stage controlled by a reference voltage VREF' that is produced from the previous reference voltage VREF, preferably through voltage division. In general, the additional reference voltage VREF' can also be provided by another suitable voltage generator. The reference voltage supplied to the additional comparator stage is therefore lower than the reference voltage supplied to voltage generators 10, 20. The additional comparator stage is dimensioned such that, in a manner comparable with the voltage generator 10, it likewise has only a low power loss. The additional comparator stage produces a control signal in order to switch the voltage generator for normal operation on and off.

Moreover, the invention indicates a method for operating such a voltage generator, in which the second voltage regulator produces the output voltage, and is controlled at the input side by the first reference voltage. The second voltage regulator is activated via the switch whenever the output voltage produced by the voltage generator falls below the additional reference voltage, which is lower than the first reference voltage.

The signal ACTIVE, indicating the normal operating state, is combined with the output signal of the additional comparator stage. The additional comparator stage can therefore activate the voltage generator for normal operation even if the control signal ACTIVE, indicating normal operation, is not activated. In comparison to the known voltage generator shown in FIG. 1, operating states are therefore also recognized in which the internal supply voltage VINT breaks down due to unforeseeable events. The additional comparator stage recognizes this error case, and switches on the voltage generator for normal operation with its high driving power. In this way, the internal supply voltage VINT is supported with a high driving power from this voltage generator, and the error state is bypassed. Of course, the voltage generator for normal operation is switched on if the control signal ACTIVE indicates normal operation.

Since the additional comparator stage is dimensioned such that it has only a low current consumption, the overall current consumption in standby operation is increased only insignificantly. Although in standby operation the inventive voltage generator has a slightly higher power consumption than the known voltage generator, and uses additional switching elements, the increase in operational reliability achieved through this additional expense is more than compensated.

The reference voltage supplied to the additional comparator stage is produced from the original reference voltage VREF by using a resistive voltage divider. This voltage divider is connected between the reference potential and the terminal connection for the reference potential VREF. An intermediate tap of the voltage divider is connected to the reference input of the additional comparator stage.

The output of the additional comparator stage produces a logical state "0" or "1" dependent on the switching state of the additional comparator stage, and the output is low-pass-filtered. The low-pass-filtered switching signal is subsequently used to control the operating state of the voltage generator for normal operation. Through the low-pass filter, it is achieved that the voltage generator for normal operation also remains in operation for a certain delay time longer, even if the internal supply voltage VINT is again sufficiently high. The voltage generator for normal operation is activated by a state "1" of the switching signal. The transition of the switching signal from "1" to "0" is thus usefully delayed.

The resistive voltage divider ensures that a threshold voltage value is provided with which internal supply voltage VINT is compared. If the internal supply voltage sinks below this switching point, the voltage generator for normal operation is switched on. If the internal supply voltage is again above normal operation, the low-pass filter ensures that the voltage generator for normal operation remains activated a certain period of time longer, until it is switched off.

The low-pass filter, which delays the transition of the switching signal from "1" to "0", can be realized as an RC filter. The delay time of the filter can be adjusted by suitably dimensioning the RC time constant. For example, the output of the comparator stage drives a transistor that is connected to the external supply voltage VEXT and to the reference potential via a resistor. The capacitor is situated in parallel to the resistor. Dependent on the switching state of the switching transistor, a logic level for a "1" or a "0" is present at the capacitor. The change of the level from "1" to "0" is delayed corresponding to the RC time constant, and is forwarded to the logic gating elements. There, the switching signals ACTIVE and PWRON, already known from the voltage generator shown in FIG. 1, are additionally logically combined. Overall, the invention effects a monitoring function that activates the voltage generator for normal operation when the internal supply voltage VINT is lowered. Such a function is known as a watchdog function. The response threshold of the watchdog function is set by the voltage divider.

All of the comparator stages are constructed in a manner corresponding to one another. They include a current switch, which is driven by the output voltage VINT and by the respective reference voltage. The current switch has two current paths that are coupled with one another, and that are connected with the reference potential via a respective current source. The current source of the current switch of the standby voltage generator is in continuous operation. The current source of the current switch of the voltage generator for normal operation is in operation only if the power-on state has been achieved, and if either the signal ACTIVE is activated, or if the additional comparator stage has detected a voltage breakdown of the internal supply voltage VINT even when the signal ACTIVE is not activated. The current source of the current switch of the additional comparator stage is preferably activated only in the power-on state, and is otherwise switched off. The transistors of the additional comparator stage and of the standby voltage generator are usefully identically dimensioned, while the transistors of the voltage generator for normal operation are dimensioned larger by a factor of n. In particular, the transistor that forms the current source of the current switch for the voltage generator for normal operation has a width that is larger by a factor of n than the comparable transistor of the standby voltage generator.

Other features which are considered as characteristic for the invention are set forth in the appended claims.

Although the invention is illustrated and described herein as embodied in a voltage generator with a standby operating mode, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
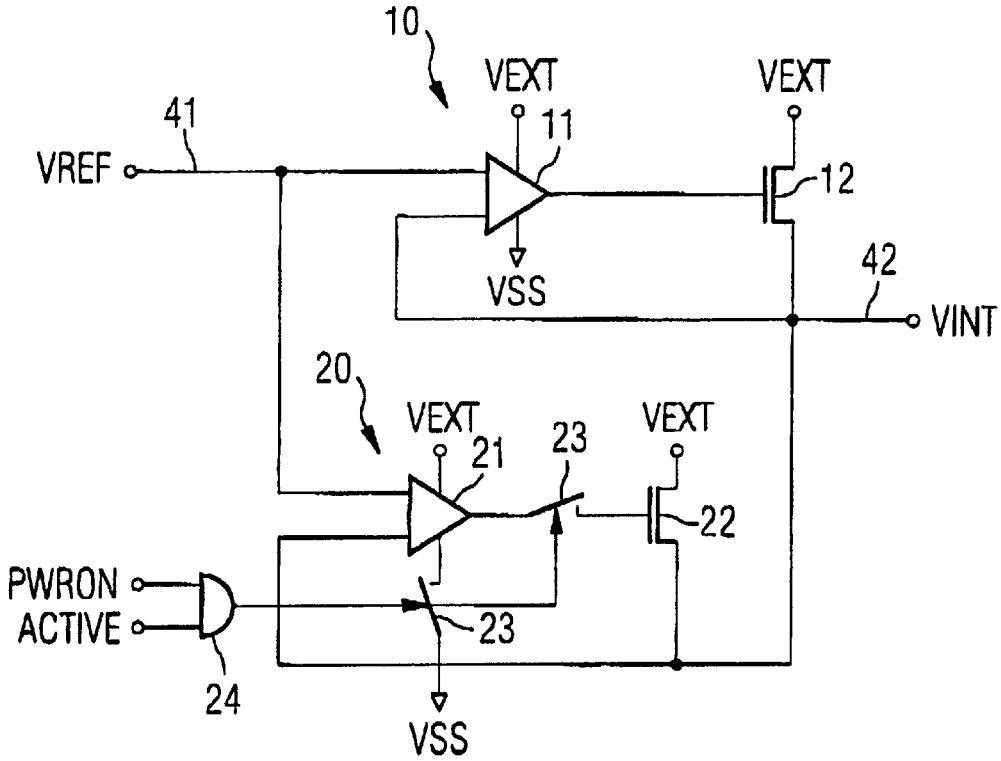
FIG 1 PRIOR ART
FIG. 1 shows a prior art voltage generator.

In the various Figures, elements corresponding to one another have been provided with the same reference characters. Referring now to the figures of the drawing in detail and first, particularly, to FIG. 2 thereof, there is shown an inventive voltage generator. The inventive voltage generator has a comparator stage 30, in addition to the known voltage generator shown in FIG. 1. The comparator stage 30 contains a differential amplifier 31 to whose reference input a voltage divider 35 is connected. Voltage divider 35 has two resistors 351, 352, connected in series, which are connected between the reference potential VREF (from terminal 41) and the reference potential VSS, here ground. Node 353, which is situated between resistors 351, 352, is connected to the reference input of the differential amplifier 31, and provides a reference voltage VREF' that is reduced in relation to VREF. The switching point of the differential amplifier 31 is therefore below the reference voltage VREF and is at the voltage level that is predetermined by the voltage divider 35. The other input of the differential amplifier 31 is connected (as are also the comparable inputs of the other differential amplifiers 11, 21) to the output terminal connection 42, which routes the internally produced supply voltage VINT. The differential amplifier 31 is supplied with voltage by the external supply voltage VEXT. A switching device 33 can switch off the differential amplifier 31 dependent on the signal PWRON. Signal PWRON indicates that the supply voltage VEXT, applied from the outside, has a sufficiently high value that the functional reliability of the supplied circuits is ensured. In principle, the switching device 33 can be omitted; then the comparator stage 30 corresponding to the standby voltage generator 10 is in continuous operation.

The output of comparator stage 30 controls a switch 34, through which one of the level values "1" or "0" can be selected. Level value "1" is for example formed by the external supply voltage VEXT. The signal provided by switch 34 is logically combined in an OR gate 26 with the signal ACTIVE that switches over between standby operation and normal operation. The output of the OR gate 26 is combined with the signal PWRON in an AND gate 25. The output of the AND gate 25 controls a switching device 23 in the voltage generator 20 for normal operation. Thus, the voltage generator for normal operation 20 is switched on only if signal PWRON signals that the power-on state has been achieved; i.e., a sufficiently high external supply voltage VEXT is present. In this case, the voltage generator is activated only if the normal operating state is present (i.e., the signal ACTIVE is activated), or if comparator stage 30, specifically the differential amplifier 31, determines that the internal supply voltage VINT lies below the reference voltage VREF' that is set by voltage divider 35 of the differential amplifier 31. The reference voltage VREF' is set according to: VREF*(R2/(R1+R2)), where R1 and R2 are the resistance values of the resistors 352 and 351.

A low-pass filter 36 is connected between the switch 34 and the OR gate 26, in order to effect a predetermined time delay, so that a switching signal produced by the switch 34 is forwarded only after the time delay brought about by the low-pass filter 36. In this way, when the internal supply voltage VINT is again above reference voltage VREF', which controls comparator stage 30, the voltage generator 20 for normal operation is not switched off immediately, but rather only after the elapse of the time delay that is predetermined by the RC constant of low-pass filter 36. In particular, the delay acts only for one of the two level edges, namely the transition from "1" to "0".

Figure 2:
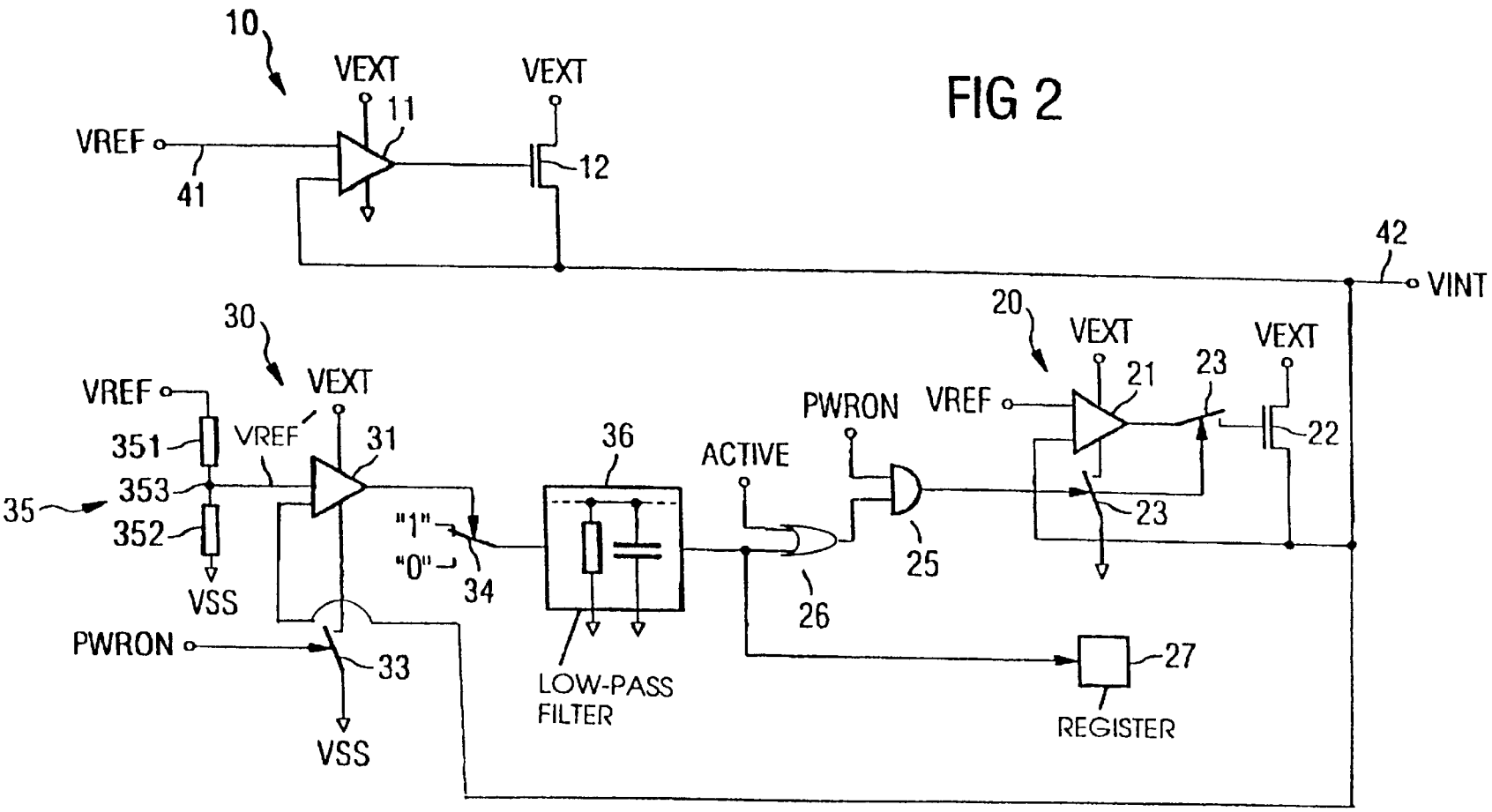
FIG. 2 is a schematic diagram of an inventive voltage generator.
Figure 3:
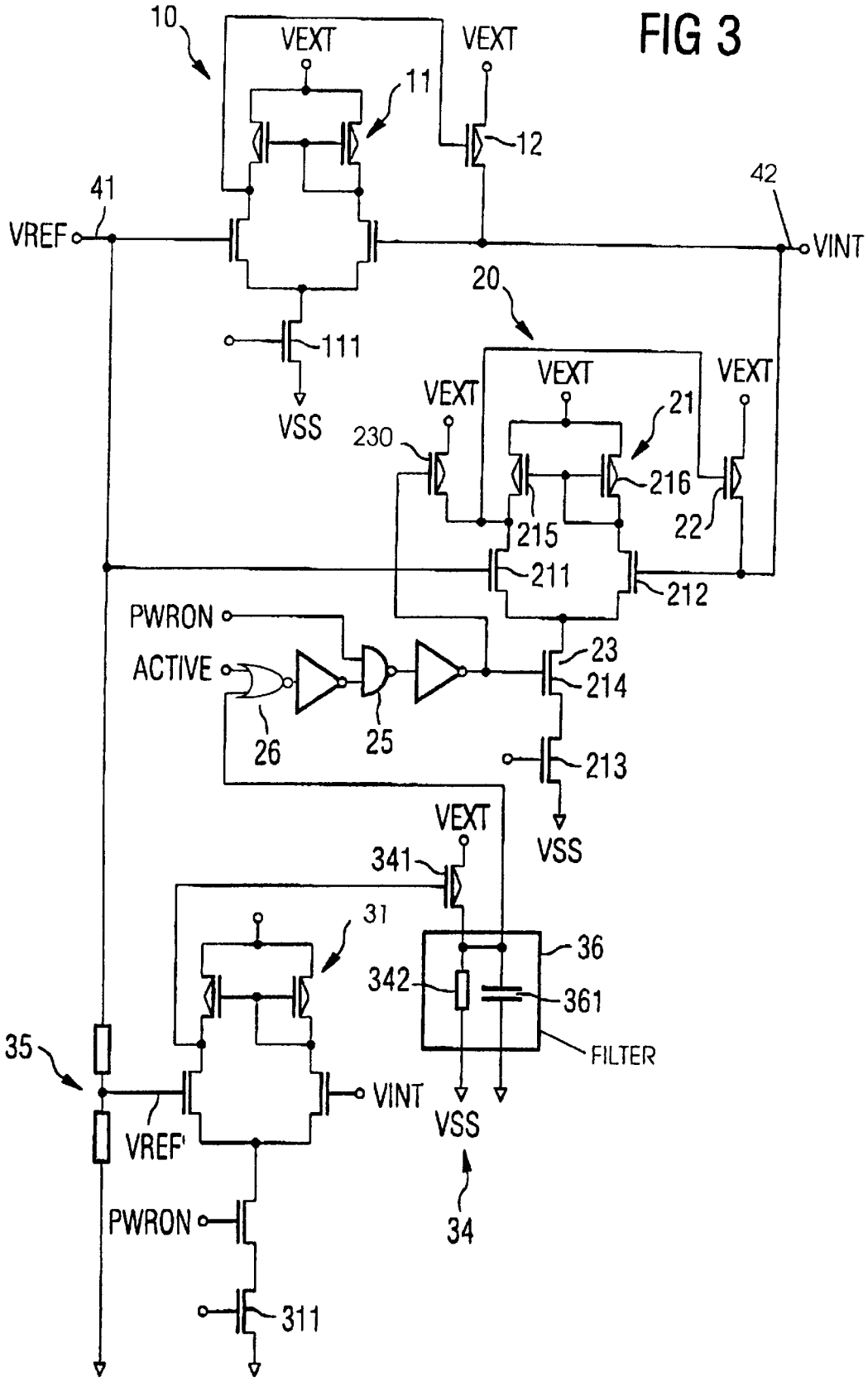
FIG. 3 is a schematic diagram showing greater details of the voltage generator shown in FIG. 2.

A more detailed example of the circuit shown in FIG. 2 is described below with reference to FIG. 3. Differential amplifier 21 in voltage generator 20 for normal operation has a current switch having two source-coupled n-channel MOS transistors 211, 212. The gate of transistor 211 is controlled using the reference voltage VREF. The base point of the current switch is connected to ground VSS via a current source formed by a current source transistor 213. The current source transistor 213 can be switched off via a switch 214 that is driven by the AND gate 25. At the load side, the current switch has p-channel MOS transistors 215, 216, connected as a current mirror circuit. The node coupling transistors 211 and 215 forms one output of the differential amplifier 21. This output is connected to the gate terminal of current source transistor 22. A pull-up resistor 230 is connected between the output of the differential amplifier 21 and the terminal for receiving the external supply voltage VEXT. The gate of the pull-up resistor 230 is driven by the AND gate 25. The internally produced supply voltage VINT provided at the output terminal connection 42 is fed back to the gate of transistor 212.

In comparison with the differential amplifier 21, the other differential amplifiers 11, 31 are of identical construction. In contrast to the differential amplifier 21, the differential amplifier 11 has a current source 111 that cannot be switched off. For this reason, the output of the differential amplifier 11 is not provided with a pull-up resistor. Differential amplifier 31 has an associated current source that can be switched only by the control signal PWRON. A pull-up resistor is not required.

The transistors of differential amplifiers 11, 31 can have the same dimensions with respect to their width-to-length ratios. The current source transistor 311 of the differential amplifier 31 and the current source transistor 111 of the differential amplifier 11 can then use the same dimensions. However, amplifiers 11 and 31 can also be dimensioned differently. However, they each have a low power loss in comparison to differential amplifier 21.

The transistors of the current switch of the differential amplifier 21 have, in comparison with the transistors of the other differential amplifiers, a width that is greater by a factor of n, in order to be able to drive a higher current. Correspondingly, the transistors 213, 214 also have a width that is greater by a factor of n. As already stated, the current source transistor 22 likewise has a width that is greater by a factor of n than the current source transistor 12 of the standby voltage generator 10.

Switch 34 is formed by a switching transistor 341 that is connected between the external supply potential VEXT and a resistor 342 that is connected to ground VSS. Transistor 341 is controlled by the output of the differential amplifier 31. A capacitor 361 is connected in parallel with resistor 342. Capacitor 361 continues the signal path, and is connected to one of the inputs of OR gate 26. Dependent on the switching state of transistor 341, either the external supply potential VEXT or the ground potential VSS is provided at the output of switch 34. Dependent thereon, the capacitor 361 is either charged via conductively switched transistor 341, or if transistor 341 is blocked, is discharged via resistor 342. An RC constant for the transition from "1" to "0" a for the switching signal supplied by the switch 34 is formed by resistor 342 and capacitor 361. This signal transition therefore has the effect that the voltage generator 20 (if the signal ACTIVE is not active) is switched-off with a delay that is determined by the RC time constant. This ensures that the internal supply voltage VINT is produced with a sufficient stability by voltage generator 20 after a voltage breakdown.

Preferably, the integrated circuit containing the voltage generator includes a register 27 that stores information concerning whether the error case of the voltage generator has already occurred at least once. Register 27 is driven by the comparator stage 30, preferably from the output of the filter 36. Register 27 is evaluated using a control program. Dependent on the stored value, corrective steps can be executed by the control program so that, in the circuits supplied by the voltage generator, further operating conditions leading to error states can be avoided to the greatest possible extent.

Overall, the specified circuit increases the operational reliability with a low circuit requirement and with low additionally consumed dissipated power. The reliability is increased by immediately compensating for unforeseen voltage breakdowns in the internal supply voltage VINT during standby operation through activating the voltage generator for normal operation 20.

We claim:

1. A voltage generator, comprising:

an output connection for providing an output voltage;

an input connection for receiving a first reference potential;

a first voltage regulator having an output stage and a comparator stage for driving said output stage, said output stage having an output connected to said output connection, said comparator stage having an input connected to said input connection for receiving the first reference potential and having another input connected to said output stage;

a second voltage regulator having an output stage, a comparator stage for driving said output stage, and a first switch, said output stage having an output connected to said output connection, said comparator stage of said second voltage regulator having an input connected to said input connection for receiving the first reference potential and having another input connected to said output stage, said first switch for switching said second voltage regulator on and off;

a connection for receiving a second reference potential that is different than the first reference potential; and an additional comparator stage having a first input connected to said connection for receiving the second reference potential, said additional comparator stage having a second input connected to said output connection, said additional comparator stage having an output providing an output signal for controlling said first switch of said second voltage regulator.

2. The voltage generator according to claim 1, comprising:

a voltage divider first having an input connected to said input connection for receiving the first reference potential;

said voltage divider having an output connected to said connection for receiving the second reference potential.

3. The voltage generator according to claim 2, comprising:

a further connection for receiving a reference potential;

said voltage divider including a first resistor and a second resistor connected in series with said first resistor;

said voltage divider connected between said input connection for receiving the first reference potential and said further connection; and said voltage divider including an intermediate tap connected to said first input of said additional comparator stage.

4. The voltage generator according to claim 1, wherein:

said comparator stage of said first voltage regulator includes a first current branch, a second current branch, and a current switch having a current source connected to said first current branch and to said second current branch;

said first current branch of said comparator stage of said first voltage regulator forms an output of said comparator stage of said first voltage regulator;

said comparator stage of said second voltage regulator includes a first current branch, a second current branch, and a current switch having a current source connected to said first current branch of said comparator stage of said second voltage regulator and to said second current branch of said comparator stage of said second voltage regulator;

said first current branch of said comparator stage of said second voltage regulator forms an output of said comparator stage of said second voltage regulator;

said additional comparator stage includes a first current branch, a second current branch, and a current switch having a current source connected to said first current branch of said additional comparator stage and to said second current branch of said additional comparator stage;

said first current branch of said additional comparator stage forms an output of said additional comparator stage;

the first reference potential controls said first current branch of said comparator stage of said first voltage regulator;

the first reference potential controls said first current branch of said comparator stage of said second voltage regulator;

the first reference potential controls said first current branch of said additional comparator stage;

the output voltage controls said second current branch of said comparator stage of said first voltage regulator;

the output voltage controls said second current branch of said comparator stage of said second voltage regulator; and the output voltage controls said second current branch of said additional comparator stage.

5. The voltage generator according to claim 4, comprising:

a connection for receiving a supply potential;

said output stage of said first voltage regulator including a transistor having a controlled path connected between said connection for receiving the supply potential and said output connection;

said transistor of said output stage of said first voltage regulator having a gate connected to said output of said output stage of said first voltage regulator;

said output stage of said second voltage regulator including a transistor having a controlled path connected between said connection for receiving the supply potential and said output connection; and said transistor of said output stage of said second voltage regulator having a gate connected to said output of said output stage of said second voltage regulator.

6. The voltage generator according to claim 4, wherein:

said current source of said second voltage regulator has a higher current driving capacity in comparison with said current source of said first voltage regulator.

7. The voltage generator according to claim 1, comprising:

a second switch that is controlled through said output of said additional comparator stage to produce one of two logic levels.

8. The voltage generator according to claim 7, comprising:

a logic gate having a first input connected to said second switch;

said logic gate having a second input for receiving an enable signal; and said logic gate having an output connected to said first switch.

9. The voltage generator according to claim 7, comprising:

a low-pass filter coupled with said second switch.

10. The voltage generator according to claim 9, comprising:

a logic gate having a first input connected to said second switch;

said logic gate having a second input for receiving an enable signal; and said logic gate having an output connected to said first switch.

11. The voltage generator according to claim 1, comprising:

a connection for receiving a supply voltage;

said additional comparator stage and said comparator stage of said second voltage regulator being switched on and off dependent on a signal that indicates whether the supply voltage is sufficiently high for supplying power to said first voltage regulator, said second voltage regulator, and said additional comparator stage; and said first voltage regulator cannot be switched on and off by the signal.

12. The voltage generator according to claim 1, comprising:

a register that is driven by said additional comparator stage.

13. A method for operating a voltage generator, which comprises:

providing a voltage generator that includes:

an output connection for providing an output voltage;

an input connection for receiving a first reference potential;

a first voltage regulator having an output stage and a comparator stage for driving said output stage, said output stage having an output connected to said output connection, said comparator stage having an input connected to said input connection for receiving the first reference potential and having another input connected to said output stage;

a second voltage regulator having an output stage, a comparator stage for driving said output stage, and a switch, said output stage having an output connected to said output connection, said comparator stage of said second voltage regulator having an input connected to said input connection for receiving the first reference potential and having another input connected to said output stage, said switch for switching said second voltage regulator on and off;

a connection for receiving a second reference potential that is different than the first reference potential; and an additional comparator stage having a first input connected to said connection for receiving the second reference potential, said additional comparator stage having a second input connected to said output connection, said additional comparator stage having an output providing an output signal for controlling said switch of said second voltage regulator;

producing the output voltage with the second voltage regulator;

using first reference potential to control the second voltage regulator;

setting the second reference voltage to be lower than the first reference voltage; and using the switch to switch on the second voltage regulator when the output voltage falls below the second reference voltage.

14. The method according to claim 13, which comprises:

setting a storage element whenever the output voltage falls below the second reference voltage.

* * * * *